US006378217B1

(12) United States Patent
Takamura et al.

(10) Patent No.: US 6,378,217 B1
(45) Date of Patent: Apr. 30, 2002

(54) APPARATUS FOR PUNCHING STEEL STUDS AND CONTROL CIRCUIT

(75) Inventors: Akio Takamura, Fuchu (JP); Jack Barney Sing, Chandler; Peter Jon Shigo, Gilbert, both of AZ (US); Colin Poon, Tsuen Wan (HK); George Michael Hornick, Anderson, SC (US)

(73) Assignee: One World Technologies, Inc., Anderson, SC (US)

( * ) Notice: Subject to any disclaimer, the term of this patent is extended or adjusted under 35 U.S.C. 154(b) by 0 days.

(21) Appl. No.: 09/611,242

(22) Filed: Jul. 6, 2000

(51) Int. Cl.[7] ..... B26F 1/14
(52) U.S. Cl. ..... 30/362; 30/358; 30/228
(58) Field of Search ..... 30/358, 360, 361, 30/362, 277.4, 218, 228; 83/684, 686

(56) References Cited

U.S. PATENT DOCUMENTS

| | | | |
|---|---|---|---|
| 503,109 | A | 8/1893 | Davis et al. |
| 1,343,872 | A | 6/1920 | Livering |
| 1,354,517 | A | 10/1920 | Sollazzo |
| 2,360,111 | A | 10/1944 | Dedona |
| 2,765,019 | A | 10/1956 | Evans |
| 2,865,451 | A | 12/1958 | Ihrig |
| 2,874,666 | A | 2/1959 | Thor |
| 3,387,525 | A | 6/1968 | Funke |
| 3,395,724 | A | 8/1968 | Hamel |
| 3,422,750 | A | 1/1969 | Anderson |
| 3,496,967 | A | 2/1970 | Timmerbeil |
| 3,541,685 | A | 11/1970 | Gizdich |
| 3,761,794 | A | 9/1973 | Quinlisk, Jr. et al. |
| 3,800,419 | A | 4/1974 | Hughes, Jr. |
| 3,863,341 | A | 2/1975 | Ramer |
| 3,877,280 | A | 4/1975 | Cornell |
| 3,925,875 | A | 12/1975 | Doke |
| 3,939,563 | A | 2/1976 | Deike |
| 3,987,695 | A | 10/1976 | Neilsen |
| 4,121,140 | A | 10/1978 | Jones |
| 4,201,130 | A | 5/1980 | Stahl |

(List continued on next page.)

FOREIGN PATENT DOCUMENTS

| | | |
|---|---|---|
| DE | 455 193 | 2/1926 |
| DE | 538 368 | 10/1931 |
| NL | 556 553 | 2/1960 |
| WO | WO 99/41046 | 8/1999 |

OTHER PUBLICATIONS

Preliminary Product Specification, Z86C02/E02/L02 Cost Effective, 512–Byte ROM CMOS Z8® Microcontrollers.

*Primary Examiner*—Hwel-Slu Payer
(74) *Attorney, Agent, or Firm*—Brooks & Kushman P.C.

(57) ABSTRACT

A portable hand-held apparatus for punching light gauge steel framing studs used in building construction to form holes of sufficient size to allow building wiring and piping to extend therethrough includes a control circuit connected to a limit switch and a main switch, and an output connected to a driving mechanism. The control circuit is configured to selectively operate the driving mechanism in response to assertion of the main switch by the user to drive the punch and die assembly from the deactuated position, over the working cycle, through the actuated position to form the punched hole, and continue to drive the punch and die assembly to the deactuated position to complete the cycle and assert the limit switch. The control circuit halts operation of the driving mechanism in response to assertion of the limit switch.

28 Claims, 8 Drawing Sheets

U.S. PATENT DOCUMENTS

| | | | | | |
|---|---|---|---|---|---|
| 4,329,867 | A | | 5/1982 | Nelson | |
| 4,571,975 | A | | 2/1986 | Pawloski et al. | |
| RE32,460 | E | | 7/1987 | Leggett, Jr. | |
| 4,707,924 | A | | 11/1987 | Burney | |
| 4,739,435 | A | | 4/1988 | Nothofer | |
| 4,773,325 | A | | 9/1988 | Shiokawa et al. | |
| 4,826,561 | A | | 5/1989 | Carroll | |
| 4,878,374 | A | | 11/1989 | Nelson | |
| 4,899,447 | A | | 2/1990 | Adleman | |
| 4,905,557 | A | | 3/1990 | Adleman | |
| 4,987,811 | A | | 1/1991 | Ikarashi et al. | |
| 4,993,104 | A | | 2/1991 | Kasper et al. | |
| 5,142,958 | A | | 9/1992 | Nordlin et al. | |
| 5,282,303 | A | | 2/1994 | Schriever | |
| 5,287,716 | A | | 2/1994 | Szule | |
| 5,294,839 | A | | 3/1994 | Jaeschke | |
| 5,416,975 | A | * | 5/1995 | Saito et al. | 30/362 |
| 5,425,262 | A | | 6/1995 | Dubugnon | |
| 5,598,635 | A | * | 2/1997 | Saito et al. | 30/362 |
| 5,630,277 | A | * | 5/1997 | Kimrua | 30/362 |
| 5,697,278 | A | | 12/1997 | Shun-Yi | |
| 5,867,909 | A | | 2/1999 | Jeltsch et al. | |

* cited by examiner

APPARATUS FOR PUNCHING STEEL STUDS AND CONTROL CIRCUIT

TECHNICAL FIELD

The present invention relates to a portable hand-held apparatus for punching steel studs to form holes of sufficient size to allow wiring and piping to extend therethrough, and sufficiently lacking sharp tongues or flanges that would damage the wiring or piping, and to a control circuit for such an apparatus.

BACKGROUND ART

Steel frame homes and structures are becoming widespread. Steel frames have many advantages over traditional wooden frames. Steel frames are termite, rust, and rot proof. Further, steel frames are non-combustible, energy efficient, and resistant to poor weather and active seismic conditions.

Steel framing is made from light gauge galvanized steel cold formed into C-shaped cross-section components. Design changes are minimized by choosing components that match lumber dimensions, particularly when converting a wooden frame design to a steel frame design. Studs come in all sizes; however, most builders use 3 ⅝ inch and 5 ½ inch sizes that match wood frame dimensions.

When building steel frame homes and structures, it is necessary to have holes punched in the studs. These punched holes, sometimes called knock-outs, accommodate plumbing and electrical wiring by allowing pipes and/or wires to run through the holes. Steel studs may be purchased with preformed holes. Many times, the preformed holes are not in the desired locations, or there are no preformed holes. In these situations, the builder must form the holes in the steel stud wherever the holes are needed.

One way to form these holes is to use an acetylene torch to cut the holes. Using an acetylene torch to cut holes in steel studs is inconvenient for a builder. Another way to form holes in steel studs is with a large mechanical lever type piercer and die tool, such as that described in U.S. Pat. No. 5,287,716 issued to Szulc. Because a builder may not realize where it is desired to form holes in the steel studs until the frame is at least partially constructed, forming the holes is difficult. Many times, it is not possible to position the large lever type tool about the steel frame to form the holes because of the large size of the lever type tool, and because of the space constraints of the partially constructed frame. Further, sometimes it is difficult to align the holes on adjacent studs such that piping may be routed therethrough without additional difficulties. Still further, smaller lever type tools are generally only useful for forming small holes such as screw holes, and are not designed to form holes sized for wiring and/or piping.

DISCLOSURE OF INVENTION

It is therefore, an object of the present invention to provide a compact hand held apparatus for punching steel studs and a control circuit for such an apparatus.

In carrying out the above object, a portable hand-held apparatus for punching light gauge steel framing studs used in building construction to form holes of sufficient size to allow building wiring and piping to extend therethrough is provided. The apparatus comprises a frame, a punch and die assembly, a driving mechanism, an assertable limit switch, an assertable main switch, and a control circuit. The punch and die assembly is supported by the frame and includes a punch and a die mounted opposite each other for movement relative to each other. The die has a body defining a cavity for receiving the punch. A driving mechanism is mounted to the frame and selectively operable to drive the punch and die assembly over a working cycle including a deactuated position and an actuated position. In the deactuated position, the punch and the die are spaced apart with the stud position therebetween. In the actuated position, the punch extends into the die cavity by punching through the stud to form the punched hole. The limit switch is asserted when the punch and die assembly is in the deactuated position. The main switch is assertable by a user.

The control circuit is connected to the limit switch and the main switch, and has an output connected to the driving mechanism. The control circuit is configured to selectively operate the driving mechanism in response to assertion of the main switch by the user to drive the punch and die assembly from the deactuated position, over the working cycle, through the actuated position to form the punched hole, and continues to drive the punch and die assembly to the deactuated position to complete the cycle and assert the limit switch. The control circuit is configured to halt operation of the driving mechanism in response to assertion of the limit switch.

In a preferred embodiment, the control circuit further comprises a timer configured to halt operation of the driving mechanism after a predetermined time elapses from the assertion of the main switch without the punch and die assembly completing the cycle.

In some embodiments, the driving mechanism is battery powered. In some embodiments, the driving mechanism is an electric motor. The motor preferably has a predetermined threshold current, and the apparatus preferably further comprises a current sensor. The current sensor is connected to the motor for sensing a motor current. The sensor is configured to provide an overload signal to the control circuit in response to the motor current exceeding the threshold current. Preferably, the control circuit is configured to halt operation of the electric motor upon receiving the overload signal.

In an alternative embodiment, the motor is operable in a first direction and in a second direction, and the control circuit is configured to reverse the direction of the motor upon receiving the overload signal. Further, in a preferred embodiment, the apparatus further comprises an overload action selection switch having a first state and a second state. The control circuit is configured to halt operation of the motor upon receiving the overload signal when the selection switch is in the first state. The control circuit is configured to reverse the direction of the motor upon receiving the overload signal when the selection switch is in the second state.

Further, preferably, the apparatus further comprises an assertable reverse switch connected to the control circuit. The control circuit is configured to operate the motor in a first direction when the reverse switch is deasserted (and the main switch is asserted) and to operate the motor in the second direction when the reverse switch is asserted. In some embodiments, the control circuit operates the motor in a second direction upon the assertion of the reverse switch followed by the assertion of the main switch. In other embodiments, assertion of the reverse switch immediately causes the motor to move in the second direction.

In a preferred embodiment, the apparatus further comprises a current sensor connected to the motor. The sensor is configured to provide a punching signal in response to the motor current exceeding a punching threshold current indicating that the punch has formed a hole. A counter holds a value representing a number of punched holes made with the apparatus, and receives the punching signal. The counter is incremented upon receiving the punching signal. Preferably, a display displays the value in the counter to the user so that the user knows when the punch should be replaced, or possibly when the battery should be replaced.

It is appreciated that an electric motor is used in preferred embodiments of the present invention, however, a turbine driven by a fluid source may be used instead of the electric motor, with the control circuit controlling a valve that provides pressurized fluid to the turbine.

In some embodiments, the frame includes a generally C-shaped portion including first and second halves. Each half includes an end, and the ends are spaced apart for holding the punch and the die and for receiving the stud between the punch and the die. The apparatus in these embodiments further comprises a slide member and an assertable safety switch. The slide member connects the first and second halves of the C-shaped frame portion and allows sliding movement of the die toward and away from the punch by moving the slide member. The assertable safety switch is asserted when the first and second frame portion halves are positioned adjacent each other, and is deasserted when the first and second portion halves are positioned apart from each other to function as an interlock switch. The control circuit is configured to selectively operate the driving mechanism while the safety switch is asserted and to block all operation of the driving mechanism while the safety switch is deasserted.

Further, in carrying out the present invention, a portable hand-held apparatus for punching light gauge steel framing studs used in building construction to form holes of sufficient size to allow building wiring and piping to extend therethrough is provided. The apparatus comprises a frame, a punch and die assembly, an electric motor, a current sensor, a counter, and a display. The punch and die assembly is supported by the frame, and includes a punch and a die mounted opposite each other for movement relative to each other. The die has a body defining a cavity for receiving the punch. The electric motor is mounted to the frame and is selectively operable to drive the punch and die assembly over a working cycle, including a deactuated position and an actuated position. The motor has a predetermined punching threshold current.

The current sensor is connected to the motor. The sensor is configured to provide a punching signal in response to the motor current exceeding the punching current threshold indicating that the punched hole has been formed. The counter holds a value representing a number of punched holes made with the apparatus and receives the punching signal. The counter increments the counter value upon receiving the punching signal. The display displays the value in the counter to the user. The counter value may indicate to the user, for example, when the punch should be replaced or when the battery should be recharged.

Still further, in carrying out the present invention, a portable hand-held apparatus for punching knock-outs out of light gauge steel framing studs used in building construction to form holes of sufficient size to allow building wiring and piping to extend therethrough is provided. The apparatus comprises a compact hand-held frame having a generally C-shaped portion with spaced apart ends for receiving a stud therebetween. The frame includes a handle for gripping by a user. The apparatus further comprises a punch and die assembly, an actuatable driving mechanism, an assertable limit switch, an assertable main switch, and a control circuit. The punch and die assembly includes a punch and a die mounted opposite each other at the ends of the C-shaped frame portion. The punch and the die are mounted for movement relative to each other, and the die has a body defining a cavity. The punch is configured with respect to the cavity such that punching a hole produces a knock-out. The driving mechanism is mounted to the frame and operable to drive the punch and die assembly over a working cycle including a deactuated position and an actuated position. The limit switch is asserted when the punch and die assembly is in the deactuated position. The main switch is assertable by user.

The control circuit is connected to the limit switch and to the main switch, and has an output connected to the driving mechanism. The control circuit is configured to selectively operate the driving mechanism in response to assertion of the main switch by the user to drive the punch and die assembly from the deactuated position, over the working cycle, through the actuated position to form the punched hole and continues to drive the punch and die assembly to the deactuated position to complete the cycle and assert the limit switch. The control circuit is configured to halt operation of the driving mechanism in response to assertion of the limit switch.

Still further, in carrying out the present invention, a portable hand-held apparatus for punching knock outs out of light gauge steel framing studs used in building construction to form holes of sufficient size to allow building wiring and piping to extend therethrough is provided. The apparatus comprises a compact hand-held frame having a generally C-shaped portion with spaced apart ends for receiving a stud therebetween and a handle for gripping by a user. The apparatus further comprises a punch and die assembly, an electric motor, a current sensor, a counter, and a display. The motor has a predetermined punching threshold current and the current sensor is connected to the motor. The sensor is configured to provide a punching signal in response to the motor current exceeding the punching threshold current indicating that the punched hole has been formed. The counter holds a value representing the number of punched holes made with the apparatus, and receives the punching signal. The counter increments the value upon receiving the punching signal. The display displays the value in the counter to the user. The punch is configured with respect to a cavity defined by the die such that punching a hole produces a knock-out.

Even further, in carrying out the present invention, a portable hand-held apparatus for punching light gauge steel framing studs used in building construction to form holes of sufficient size to allow building wiring and piping to extend therethrough is provided. The apparatus comprises a frame, a punch and die assembly, and a driving mechanism. The apparatus further comprises an assertable first limit switch, an assertable main switch, and a control circuit. The first limit switch is asserted when the punch and die assembly is in the deactuated position. The main switch is assertable by a user. The control circuit is connected to the first limit switch and the main switch, and has an output connected to the driving mechanism. The control circuit is configured with an interlock circuit to allow selective operation of the driving mechanism in response to a momentary assertion of the main switch by the user to drive the punch and the die assembly. The punch and the die assembly is driven from the deactuated position, over the working cycle, through the actuated position, to form the punched hole. The control circuit is further configured to halt operation of the driving mechanism when the first limit switch is asserted after driving the punch and die assembly over the working cycle to the deactuated position.

In this embodiment of the present invention, preferably, the interlock circuit is configured to maintain a power connection to the control circuit after the control circuit halts the driving mechanism. Further, the control circuit preferably includes a timer. The timer may be utilized together with other aspects of the control circuit to provide enhanced control over the apparatus, as explained in the below description of preferred control circuit features.

Preferably, the control circuit is configured to reset the interlock circuit and disconnect the power connection to the control circuit when the timer exceeds a power down threshold. The timer is reset by the momentary assertion of the main switch. Preferably, the control circuit is configured to halt the driving mechanism when the timer exceeds an initial movement threshold before the first limit switch is deasserted. Further, preferably, the apparatus further comprises an assertable second limit switch that is asserted when the punch and die assembly has moved sufficiently from the deactuated position toward the actuated position such that the punched hole has been formed. The control circuit is configured to halt the driving mechanism when the timer exceeds a punch time out threshold before the second limit switch is asserted. Alternatively, the control circuit is configured to reverse the driving mechanism when the timer exceeds a punch time out threshold before the second limit switch is asserted. Further, the control circuit may halt the driving mechanism when the timer exceeds a reverse return time out threshold before the first limit switch is asserted after the reversing of the driving mechanism. And further, preferably, the control circuit is configured to halt the driving mechanism when the timer exceeds a forward return time out threshold before the first limit switch is asserted after the punch and die assembly begins the working cycle. In a preferred embodiment, the apparatus further comprises an assertable safety switch. The control circuit is configured to prevent operation of the driving mechanism while the safety switch is deasserted.

Preferred implementations utilize a compact hand-held frame having a generally C-shaped portion with spaced apart ends for receiving the stud therebetween. More preferably, the punch is configured with respect to the cavity such that punching a hole produces a knock-out.

The advantages accruing to the present invention are numerous. For example, the control circuit in some embodiments of the present invention allows a main switch to selectively operate the driving mechanism, while a limit switch detects when the punch is in the home or fully retracted position to stop the punch on the completion of the working cycle. Further, in some embodiments, a current sensor detects the current passing through an electric drive motor. The sensor is connected to a counter that counts holes formed. A display may indicate the value in the counter to a user to let the user know when the punch and/or die should be changed or when the battery should be recharged.

Further, embodiments of the present invention provide a compact hand-held tool for punching steel studs to form holes of sufficient size to allow wiring and piping to extend therethrough. In a preferred construction, a gross adjust mechanism and undercut jaws provide tool versatility, particularly for punching holes in steel studs which are already secured with a partially constructed frame. Preferably, the punch is configured with respect to the die cavity such that punching the hole produces a knock-out. Still further, it is preferred that an annular gap between the punch and the die cavity, when the punch is extended into the die cavity is sufficiently small such that the punched hole is substantially flangeless. That is, the hole sufficiently lacks sharp tongues or flanges that would damage the wiring or piping.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
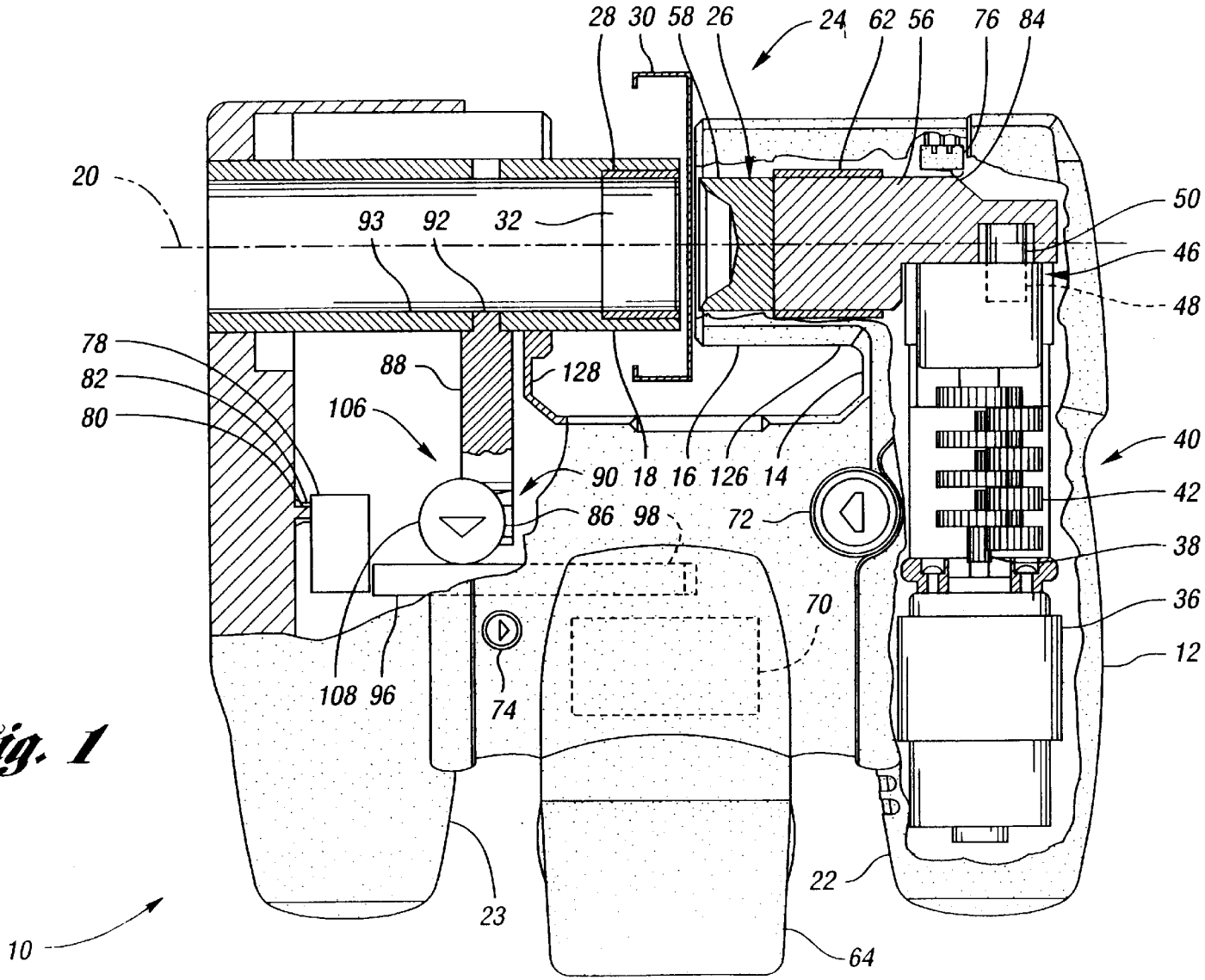
FIG. 1 is a side elevational view in partial broken away section illustrating an apparatus of the present invention for punching steel studs, showing the punch and the die in the closed position, and deactuated, with a stud therebetween.
Figure 2:
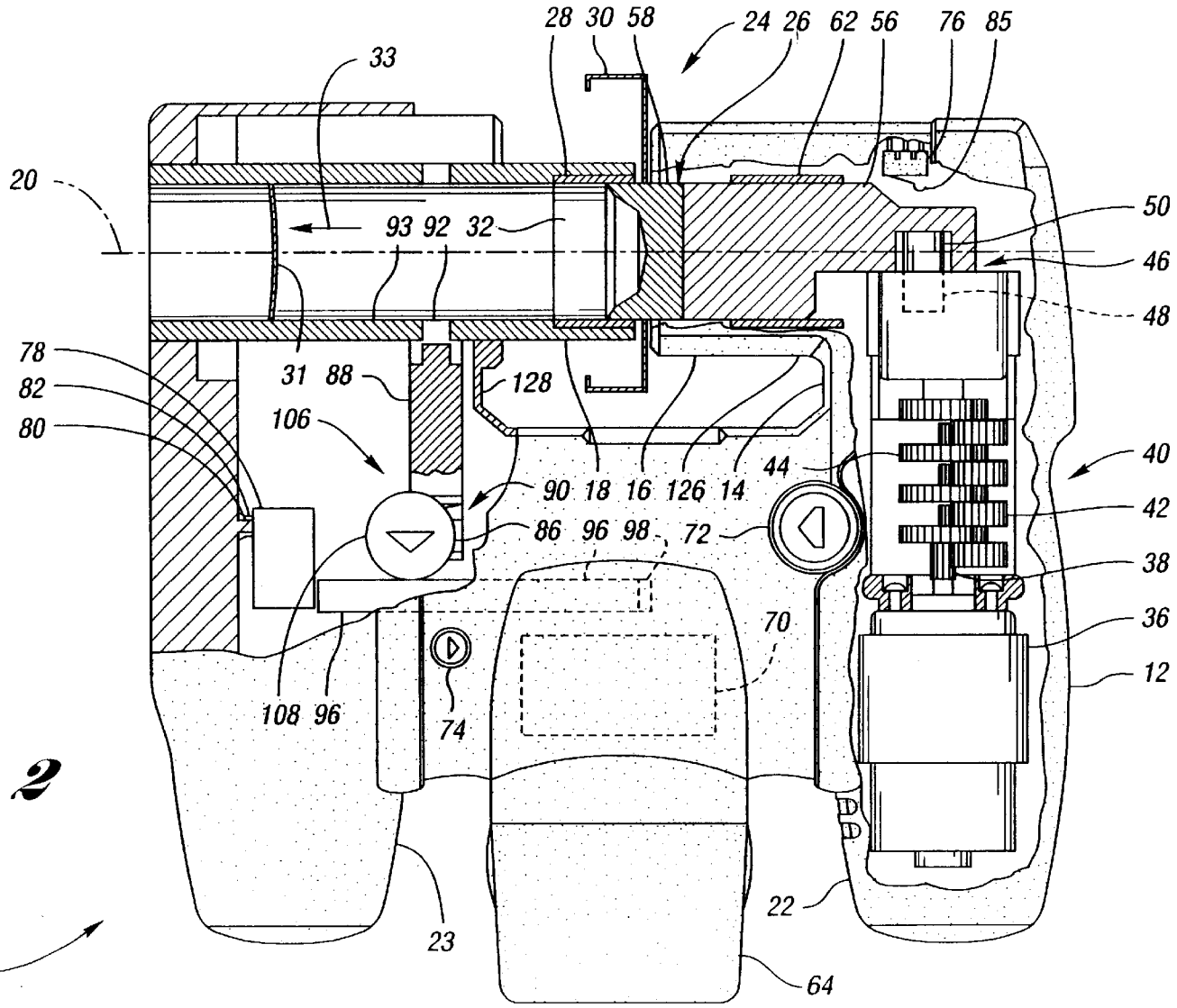
FIG. 2 is a side elevational view similar to FIG. 1, showing the punch and the die in the closed position, and actuated, with the punch extending through the stud to produce a knock-out.
Figure 3:
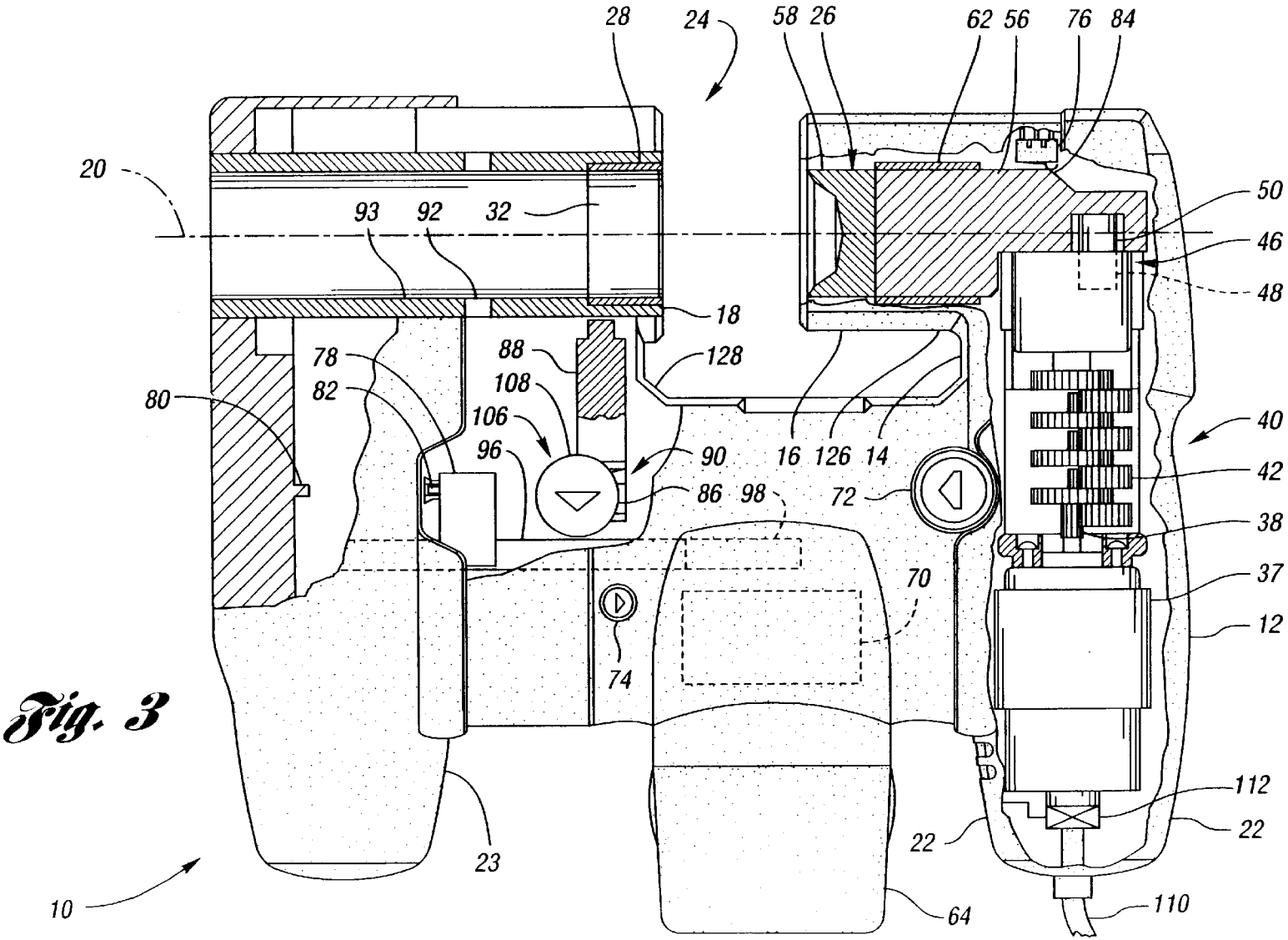
FIG. 3 is a side elevational view similar to FIG. 1, showing the punch and die in the open position allowing the positioning of the stud therebetween.

With reference to FIGS. 1–3, an apparatus for punching steel studs is generally indicated at 10. The apparatus 10 includes a compact hand held frame 12. The frame 12 has a generally C-shaped portion 14 with first and second ends 16 and 18, respectively. The first end 16 and second end 18 are spaced apart and located along a working axis 20 for receiving a stud 30 therebetween. Right and left handles 22 and 23, respectively, are provided for gripping by a user when operating the apparatus 10.

A punch and die assembly 24 includes a punch 26 and a die 28. Punch 26 is mounted to first end 16 of C-shaped frame portion 14. Die 28 is mounted to second end 18 of C-shaped frame portion 14, opposite punch 26. The stud 30 is shown between punch 26 and die 28. Punch 26 and die 28 are mounted for movement relative to each other along the working axis 20. Die 28 has a cavity 32 so that punch 26 may extend into cavity 32 of die body 28, punching through stud 30 during operation (as shown in FIG. 2), producing knock-out 31.

An actuatable driving mechanism, such as an electric motor 36 (FIG. 1), or a fluid driven turbine 37 (FIG. 3) is mounted to the frame 12. Electric motor 36 (FIG. 1) has a drive shaft 38. A gear reduction assembly 40, includes a number of reducing gears 42, 44 with each gear having a large diameter gear that is driven and a smaller diameter gear that drives the next gear in the mechanism 40. The last stage of the gear reduction assembly 40 drives punch and die assembly 24 via a suitable cam mechanism, such as cam mechanism 46.

As shown, cam mechanism 46 includes a socket 48. Punch 26 includes a punch body 56 secured to a punch head 58 by a suitable fastener (not shown). The punch body 56 is supported by a bearing 62. Cam mechanism 46 further includes a roller pin 50 which cooperates with socket 48 to impart reciprocal driving motion to punch 26.

As best shown in FIG. 1, electric motor 36 is powered by a suitable power source such as a battery source 64. However, embodiments of the present invention may include a power cord 110 for connection to a conventional power outlet. Alternatively, other types of driving mechanisms may be utilized. For example, instead of using an electric motor 36 as best shown in FIG. 1, a turbine 37 may be used as best shown in FIG. 3.

It is to be understood that the electric motor driven embodiment illustrated in FIGS. 1 and 2 and the turbine driven embodiment illustrated in FIG. 3 operate substantially identically, apart from their respective drive mechanisms. To simplify the description of the invention, like reference numerals are used in FIGS. 1–3 to indicate similar elements.

With continuing reference to FIGS. 1–3, power is selectively supplied to electric motor 36 (FIGS. 1 and 2) as will be described in detail later herein when the drive and control circuit is described. Drive shaft 38 may be rotated in either direction. The rotation of drive shaft 38 causes reciprocal movement of punch 26 over a working cycle. Punch 26 moves between a deactuated position, (FIG. 1), and an actuated position (FIG. 2). In the deactuated position, punch 26 and die 28 are spaced apart with the stud 30 positioned therebetween. In the actuated position, punch 26 extends into the die cavity 32 by punching through the stud 30 to produce knock-out 31 which may be dropped out the back end of the die holder as indicated by arrow 33.

Alternatively, as best shown in FIG. 3, the driving mechanism may be a turbine 37. Turbine 37 drives drive shaft 38 and is powered from a compressed fluid source (not specifically illustrated). A valve 112 is actuatable by start button 72 in the same way that the control circuit actuates the electric motor (FIGS. 1 and 2) when button 72 is pressed. An inlet connector located on frame 12 connects to a suitable fluid source such as a compressed air tank. Gear reduction assembly 40 may provide more speed reduction in the turbine driven embodiment than in the electric motor driven embodiment to accommodate for increased shaft speed in the turbine.

In embodiments of the present invention, the apparatus is portable and hand-held and is configured such that the punched holes are of sufficient size to allow building wiring and piping to extend therethrough. Further, in preferred embodiments, the punch is configured with respect to the die to produce a knock-out when punching the hole. One technique that may be utilized to produce knock-outs is sizing the punch relative to the die cavity such that an annular gap between the punch and the die cavity, when the punch is extended into the die cavity, is sufficiently small such that the punched hole produces a knock-out and is substantially flangeless. That is, a substantially flangeless punched hole is sufficiently lacking sharp tongues or flanges that would damage the wiring or piping intended to pass therethrough.

With reference to FIGS. 1–3, a gross adjust mechanism 90 is configured for moving the punch 26 and the die 28 relative to each other over a gross adjust stroke range significantly larger than that required to punch through the stud between an open position (FIG. 3), and a closed position (FIG. 1 shows closed/deactuated, FIG. 2 shows closed/actuated). In a preferred embodiment, C-shaped frame portion 14 includes a first half including handle 22 and a second half including handle 23. Electric motor 36 (FIGS. 1 and 2) or turbine 37 (FIG. 3) is disposed in the first housing half. The second housing half is connected to the first housing half by a lockable slide member 96 fixed to second housing half 23 and a corresponding guide slot 98 within first housing half 22. Sliding member 96 allows sliding movement of the die 28 toward and away from the punch 26 along the working axis 20, over the gross adjust stroke range.

A lock device for gross adjust mechanism 90 is generally indicated at 106. A push button 108 is operable to unlock the device. Button 108 is operable to move lock member 88 against the bias of spring 86. When lock button 108 is not pressed, as best shown in FIGS. 1 and 2, lock member 88 engages a recess 92 in die holder 93 to lock die holder 93 and prevent movement of slide member 96 during actuation of the driving mechanism (electric motor 36, turbine 37, or another suitable driving mechanism). Actuation (pressing) of lock button 108 causes movement of lock member 88 causing lock member 88 to disengage from recess 92 as best shown in FIG. 3. Disengagement of lock member 88 from recess 92 unlocks the die holder 93 to allow sliding movement of die 28 toward and away from punch 26 by allowing slide member 96 to slide within guide slot 98.

Further, in a preferred embodiment, both ends 16 and 18 of C-shaped frame portion 14 include undercut jaw portions 126 and 128 to allow positioning of differently shaped studs between punch 26 and die 28. The gross adjust stroke range is significantly larger than that required to punch through the stud to allow positioning of differently shaped studs between punch 26 and die 28. The working stroke range is not significantly larger than that required to punch through the stud to allow a short powerful stroke for the punch and die assembly. Thus, the advantages of undercut jaws on the C-shaped frame ends are immense.

It is to be appreciated that gross adjust mechanism 90 may be constructed in a variety of other ways in addition to that utilizing slide member 96. For example, the gross adjust stroke range may be defined along a plane substantially perpendicular to the working axis. A lockable hinge member connecting the first and second halves of the C-shaped frame portion allows hinged movement of the die toward and away from the punch along the plane. The lock device allows unlocking of the hinge member to move the hinge member through the plane, and allows locking of the hinge member to prevent movement of the hinge member during operation of the driving mechanism.

Further, for example, the gross adjust mechanism may include a lockable pivot member connecting the first and second halves of the C-shaped frame portion and allowing arcuate pivotal movement of the punch toward and away from the die along a plane parallel to the working axis. A lock device allows unlocking and locking of the pivot member.

Alternatively, the gross adjust mechanism may be omitted, provided that the working stroke range is sufficiently large so as to allow positioning of a stud between the punch and die. However, the use of a gross adjust mechanism is preferred so that the working stroke range may be shortened, decreasing the punch travel and increasing the applied force from punch 26. Further, undercut jaws are preferably employed in conjunction with the gross adjust mechanism to provide increased tool versatility.

Further, it is to be appreciated that there are various alternative embodiments for the cam mechanism, which is illustrated as a slot and pin arrangement. For example, a spring may be disposed within the frame to urge the punch away from the die. A cam lobe mounted to the output portion of the gear reduction assembly may force the punch through the stud against the bias of the spring upon actuation of the driving mechanism.

With continuing reference to FIGS. 1–3, apparatus 10 includes a limit switch 76. Limit switch 76 is configured such that the switch is asserted when the punch and die assembly is in the deactuated position, as shown in FIGS. 1 and 3. Similarly, when the punch and die assembly is in the actuated position, the limit switch is deasserted (FIG. 2). As shown, limit switch 76 includes a lever shown in the asserted position at 84 (FIGS. 1 and 3), and the lever is shown in the deasserted position at 85 (FIG. 2). Of course, it is appreciated that the terms asserted and deasserted refer to the logic level of an output of the limit switch. That is, the terms asserted and deasserted are not meant to import mechanical limitations to the operation of the limit switch, but rather are used to designate the first and second states for the limit switch, and specify which of these two states corresponds to the punch and die assembly being deactuated. That is, the limit switch has two states, asserted being one and deasserted being another. Further, although a mechanical limit switch is illustrated, there are other implementations for an assertable limit switch. For example, a magnetic sensor may be configured to detect when the punch and die assembly is deactuated.

In addition to limit switch 76, apparatus 10 includes main switch 72 that is assertable by a user. As shown, main switch 72 is a push button switch wherein the asserted condition for the switch occurs when the button is pressed. In preferred embodiments, a reverse switch 74 (shown as a push button switch) is also included on apparatus 10. The various switches cooperate with the punch control circuit 70. In addition to the limit switch 76, main switch 72, and optional reverse switch 74, in preferred embodiments of the present invention, a safety switch 78 is also provided. Safety switch 78, also referred to as an interlock switch because safety switch is asserted when first and second housing halves 22 and 23, respectively, are brought together to allow locking mechanism 106 to lock die holder 93 into position. Safety switch 78 is configured such that when the switch is open (deasserted), the power connection from battery 64 (or other suitable power source) to electric motor 36 (or other suitable driving mechanism) is broken. Safety switch 78 is shown in the deasserted or disengaged condition in FIG. 3. In FIGS. 1 and 2, the safety switch 78 is asserted (closed). Further, there are many ways to implement a safety switch, and as shown, protrusion 80 is received in recess 82 to press a button and assert the safety switch as the housing halves are brought together, connecting the power source to the driving mechanism.

Figure 4:
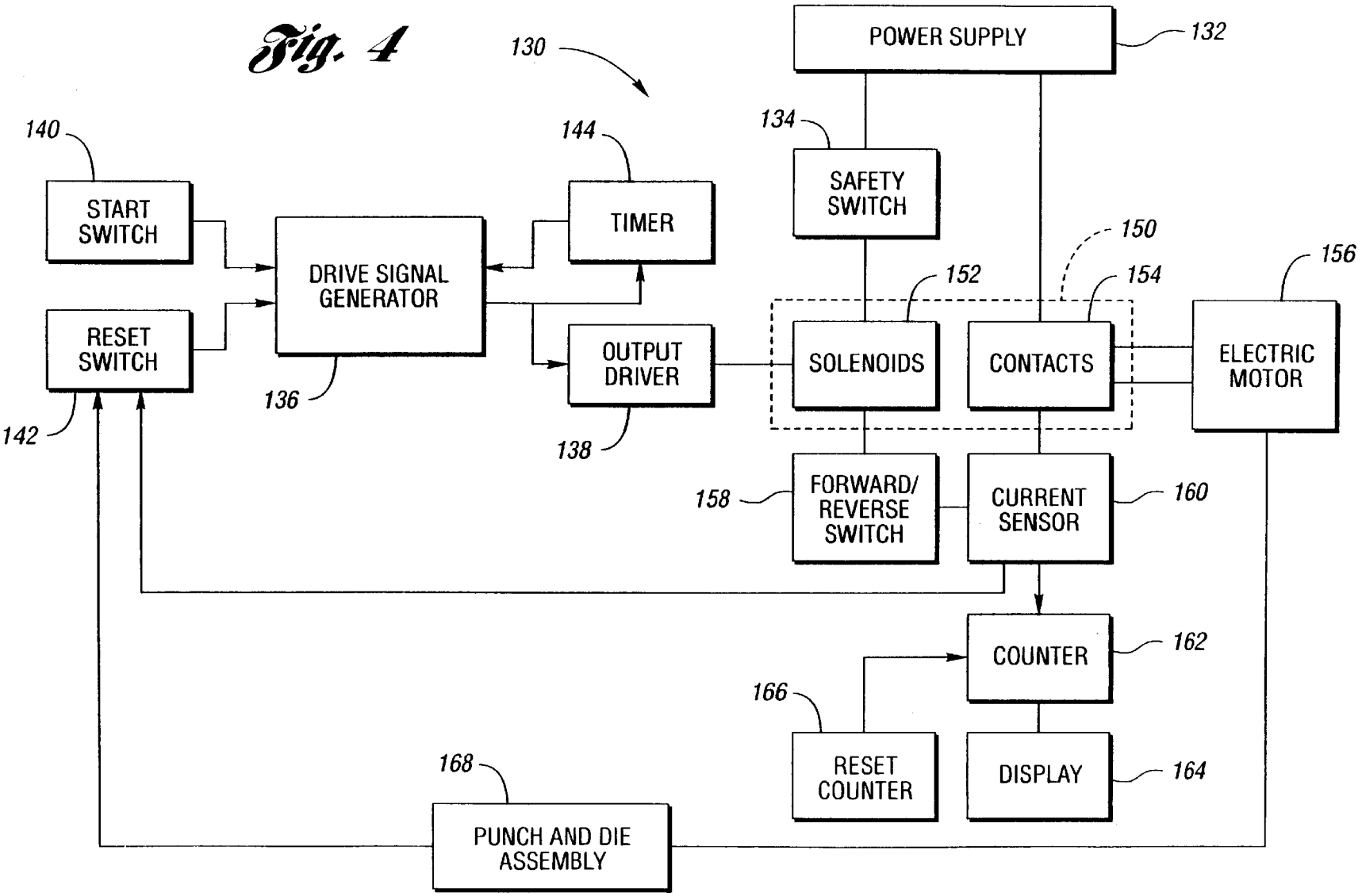
FIG. 4 is a logical block diagram for the control circuit in an embodiment of the present invention.
Figure 5:
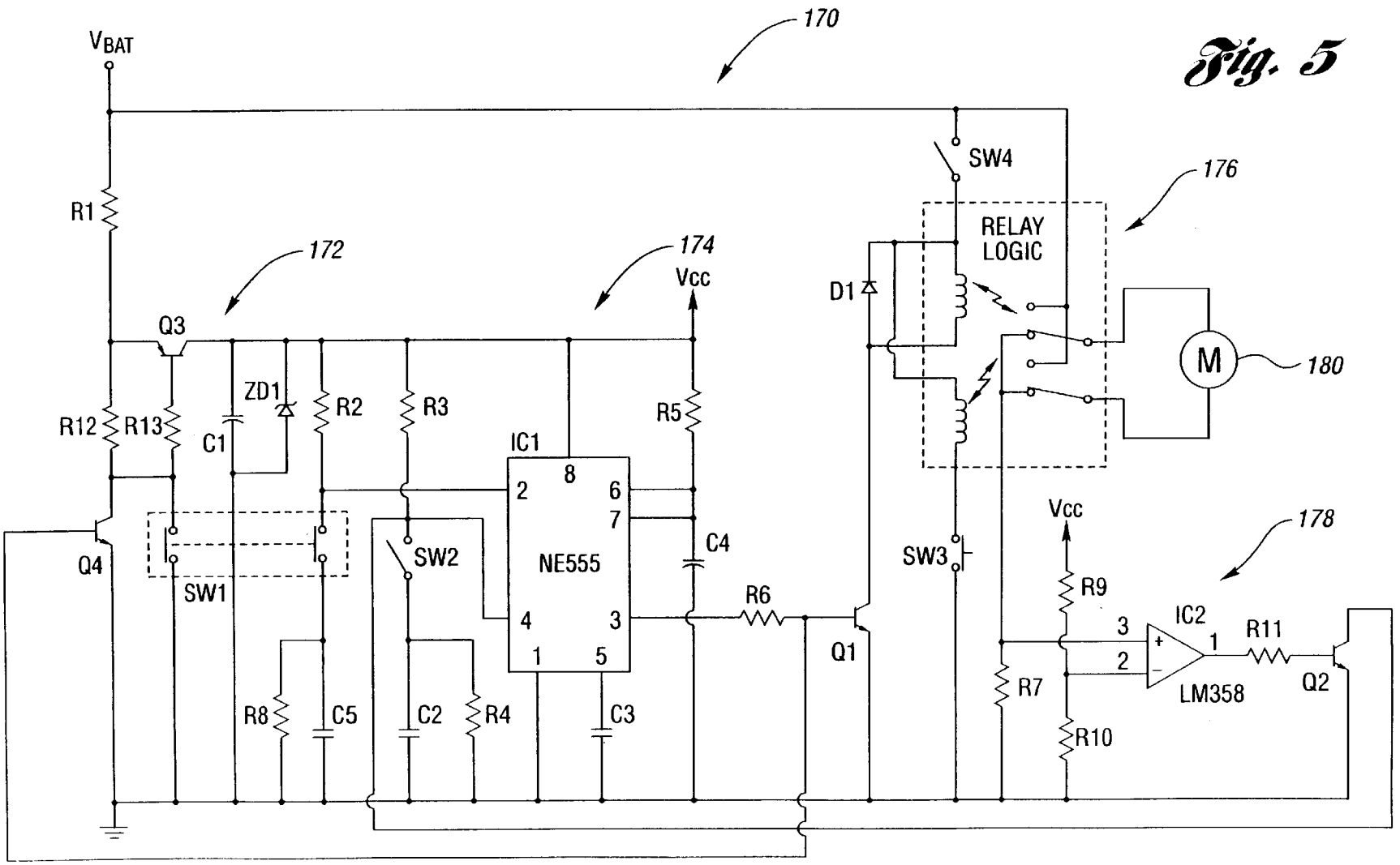
FIG. 5 is an example of a suitable circuit for implementing the control circuit illustrated in FIG. 4.

FIG. 4 illustrates the operation of a control circuit in accordance with an embodiment of the present invention. In FIG. 4, the control circuit is shown at the logical level, and it is appreciated that the present invention is not limited to any particular circuit level implementation, although a working example of a circuit implementation is shown in FIG. 5. In FIG. 4, a logical level diagram of the control circuit is generally indicated at 130.

Control circuit 130 is logically configured in accordance with the present invention to selectively drive a suitable driving mechanism for the hand held punch, such as an electric motor (FIGS. 1 and 2). In the alternative, control circuit 130 may be used to actuate a valve to selectively supply fluid power to a turbine driven embodiment (FIG. 3). Accordingly, control circuit 130 is not limited to any particular type of driving mechanism, but is shown configured to selectively connect power to an electric motor for illustration. Control circuit 130 draws power from a power supply 132. A safety switch 134 connects power supply 132 to the driver portion of control circuit 130. Safety switch 134 is preferably an interlock switch that is closed when the punch and die assembly is closed, and is opened when the punch and die assembly is open to position a stud between the punch and the die. Control circuit 130 includes a drive signal generator 136 connected to an output driver 138. A start switch 140 and a reset switch 142 are connected to drive signal generator 136. It is appreciated that the blocks in FIG. 4 are logical blocks, and that a suitable circuit level implementation may vary in structure depending on the implementation. Logical start switch 140 is connected to start button 72 (FIGS. 1–3), while logical reset switch 142 is connected to limit switch 76 (FIGS. 1–3). Drive signal generator 136 is configured such that the logical assertion of start switch 140 (the pressing of main switch for the apparatus) by the user causes the signal generator 136 to drive output driver 138. Output driver 138, in turn, drives the driving mechanism via an appropriate output circuit. As shown, for an electric motor embodiment, output driver 138 drives relay logic 150. More particularly, output driver 138 drives solenoids 152 to cause contacts 154 to connect electric motor 156 to power supply 132. In the implementation shown with safety switch 134, safety switch 134 must be closed for output driver 138 to effectively drive solenoids 152.

In response to assertion of logical start switch 140, drive signal generator 136 causes output driver 138 to drive the punch and die assembly (when safety switch 134 is closed) from the deactuated position, over the working cycle, through the actuated position to form the punched hole, and continues to drive the punch and die assembly 168 to the deactuated position to complete the cycle and assert the limit switch, asserting logical reset switch 142. Control circuit 130, and more particularly, drive signal generator 136, is configured to halt operation of the driving mechanism in response to assertion of the reset switch by halting output driver 138. In a preferred embodiment, a timer 144 is configured to halt operation of the driving mechanism after a predetermined time elapses from the assertion of logical start switch 140 (which is asserted by the main switch) without the punch and die assembly 168 completing the cycle. That is, assertion of start switch 140 initiates a pulse at output driver 138 of a predetermined pulse width. The pulse width is determined by timer 144. That is, output driver 138 drives the driving mechanism until the expiration of timer 144 or the assertion of logical reset switch 142 (asserted by the limit switch). The timer 144 is particularly useful for battery driven embodiments of the present invention so that when the battery gets low, drive signal generator 136 will not continue to drain the battery when battery power is already so low that the punch cannot complete a working cycle and flip the limit switch.

In a preferred embodiment, control circuit 130 further includes a forward/reverse switch 158, and a current sensor 160. Forward/reverse switch 158 allows the motor to be driven in the reverse direction by changing the interaction of solenoids 152 and contacts 154 when switch 158 is asserted. Current sensor 160 detects current through electric motor 156, and in the event that the motor current exceeds a predetermined overload threshold, asserts the logical reset switch 142 to halt the motor drive signal. In the alternative, excessive motor current could automatically assert the logical reverse switch and cause the motor to reverse. A switch could be provided to select how the apparatus responds to a motor current overload.

In another aspect of the present invention, the current sensor 160, in addition to halting operation of the electric motor by generating an overload signal when current exceeds the predetermined threshold, is configured to provide a punching signal to counter 162 when the motor current exceeds a predetermined punching threshold current indicating that the punched hole has been formed. Counter 162 counts the punched holes based on current spikes occurring every time a hole is punched. The number in counter 162 may be displayed on display 164 for the user to view. By indicating to the user the number of holes that have been punched, the user may estimate, for example, when the punch or die needs to be changed or when the battery is getting low. Reset counter logic 166, preferably connected to a switch accessible to the user, allows counter 162 to be reset. The counter could be powered by the battery, or by a separate power source such as a small lithium ion battery.

In general, the various logical portions of control circuit 130 cooperate to selectively drive electric motor 156 (or other suitable driving mechanism) to drive the punch and die assembly 168 over a working cycle to punch a hole in a steel framing stud. In operation, the closing of a physical safety/interlock switch asserts the logical safety switch 134 to connect power supply 132 to relay logic 150. Upon the momentary assertion of a physical main switch or start switch, logical start switch 140 is asserted, and drive single generator 136 receives a start signal. Drive signal generator 136 generates an output signal having a predetermined pulse width. The pulse width of the output signal is predetermined by logical timer 144. Output driver 138 completes the connection of power supply 132 to solenoids 152 (when the safety switch is closed). Energization of solenoids 152 operates the relay contacts 154 in such a way to connect power supply 132 to electric motor 156. Electric motor 156 drives punch and die assembly 168 over the working cycle. When the working cycle for the punch and die assembly is completed, the physical limit switch is asserted by the retracting punch, asserting the logical reset switch 142. Upon assertion of the logical reset switch 142, drive signal generator 136 halts the signal to output driver 138. On the other hand, drive signal generator 136 also halts the signal to output driver 138 if timer 144 expires before the working cycle of the punch is completed (for example, low battery).

In addition to the general operation described immediately above, preferred embodiments of the present invention have additional features in the logical control circuit 130. Preferably, a forward/reverse logical switch (connected to a physical forward/reverse switch) allows the electric motor 136 to be operated in the opposite direction of the normal operating direction. In some configurations, assertion of the physical and logical reverse switches causes the motor to immediately drive in reverse. In other embodiments, the reverse switch changes the configuration of an internal circuit of relay 150, and the motor is driven in reverse when the main switch and logical start switch 140 are asserted. Further, in the preferred implementation, current sensor 160 monitors the motor current. The motor current may be compared to a predetermined motor overload current, and an overload signal is provided to logical reset switch 142 in the event that the motor current exceeds the predetermined threshold current. In the alternative, the current overload detected by current sensor 160 would cause current sensor 160 to request that logical reverse switch 150 reverses the direction of the motor to back the punch off.

In another implementation utilizing current sensor 160, a predetermined punching threshold current is established for the electric motor. Current sensor 160 detects the motor current during operation and compares the current to the predetermined punching threshold current. When the current sensor detects that the motor current exceeds the predetermined punching threshold current, a punching signal is provided to counter 162. Counter 162 holds a value representing a number of punched holes made with the apparatus. Upon receiving the punching signal, the counter increments the value stored therein. A display 164 displays the value in the counter to the user. Preferably, reset counter logic 166 is provided to allow the counter to be reset.

With reference now to FIG. 5, a working example of a control circuit at the component level is generally indicated at 170. It is appreciated that the control circuit 170 of FIG. 5 is one implementation for the control circuit 130 shown in FIG. 4, and many implementations are possible in accordance with the present invention. Circuit 170 includes a voltage regulator circuit 172 formed by resistor R12, resistor R13, transistor Q3, capacitor C1, and zenor diode Z1. Resistor R1 divides out a portion of the voltage, VBAT, from the battery. Switch SW1 is the main switch, and transistor Q4 receives a feedback input from the single generator output such that the momentary pressing and then releasing of switch SW1 supplies power to voltage regulator circuit 172, and thereafter, transistor Q4 is in an on state to provide a path between VBAT and ground, forming an interlock circuit. Connected to voltage regulator circuit 172 is the signal generator circuit 174. The main component of signal generator circuit 174 in the exemplary embodiment is integrated circuit chip IC1, which is an NE555 timer. In the timer IC, pin 1 is the ground, pin 2 is the trigger input, pin 3 is the output, pin 4 is reset, pin 5 is the control voltage, pin 6 is the threshold, pin 7 is the discharge, and pin 8 is the power supply. Switch SW1 is actually two switches at the circuit level, with the switch shown to the left providing a momentary path to ground for the battery to switch Q3 on, and the switch to the right providing a trigger pulse at the trigger input of the timer IC. When SW1 is closed, resistor R2 is momentarily connected to resistor R8 and capacitor C5, creating a trigger pulse at the trigger input. When the trigger pulse is received, the output of the timer is pulled the high to drive output driver transistor Q1 through base resistor R6 and turn on Q4 at the interlock circuit.

Regardless of whether or not the working cycle is ever completed by the punch, the output of the timer IC has a predetermined pulse width or timeout determined by resistor R5 and capacitor C4. In a suitable implementation, R5 and C4 are selected such that C4 reaches the threshold voltage for the timer IC in about two seconds, causing the output to be pulled low after being high for two seconds.

Capacitor C3 connects the control voltage pin to ground. Switch SW2 is the reset switch, and is connected to the limit switch. When the punch completes a working cycle and asserts the limit switch, switch SW2 is closed, momentarily pulling the reset pin low when resistor R3 is connected to capacitor C2 and resistor R4. In addition to the reset pin of the timer IC being pulled low by the closing switch SW2, a current overload at the electric motor may also pull the reset input low.

Transistor Q1 is the output driver for signal generating circuit 174. Transistor Q1 selectively supplies power to the motor by driving relay logic 176. Switch SW4 is the safety/interlock switch. As can be shown by examining FIG. 5, the motor cannot be driven unless switch SW4 is closed. When switch SW4 is closed, turning on transistor Q1 actuates relay logic 176 to supply power to electric motor 180. Diode D1 limits the voltage at the collector of transistor Q1. Switch SW3 is a manual reverse switch. In the working example illustrated, closing switch SW3 manually (when switch SW4 is closed) drives the motor in a reverse direction by driving the solenoid driver in relay logic 176. Of course, as appreciated by those skilled in the art, various relay logic techniques may be utilized to change the effects of the switch SW3 on overall operation as mentioned previously herein.

With continuing reference to FIG. 5, in preferred embodiments, a current detector circuit 178 is connected to electric motor 180. The main component of the current detector circuit is integrated circuit chip IC2, which is an LM358 comparator. For the comparator, pin 1 is the output, pin 2 is the negative input, and pin 3 is the positive input. Resistors R9 and R10 provide a threshold voltage for the comparator. As shown, the threshold voltage should be set to the motor overload current for the particular electrical motor being used. Resistor R7 detects the motor drive current. The drive current and the current threshold are compared (as voltages) by the comparator, and the output of the comparator drives transistor Q2 through resistor R11. When motor current exceeds the threshold, the output of the comparator turns on transistor Q2 to pull the reset input of the timer IC low, causing a reset.

It is appreciated that the control circuit example shown in FIG. 5 is not meant to limit the present invention to any particular circuit structure, but is given as a working example of a control circuit for use in an apparatus of the present invention.

Figure 6:
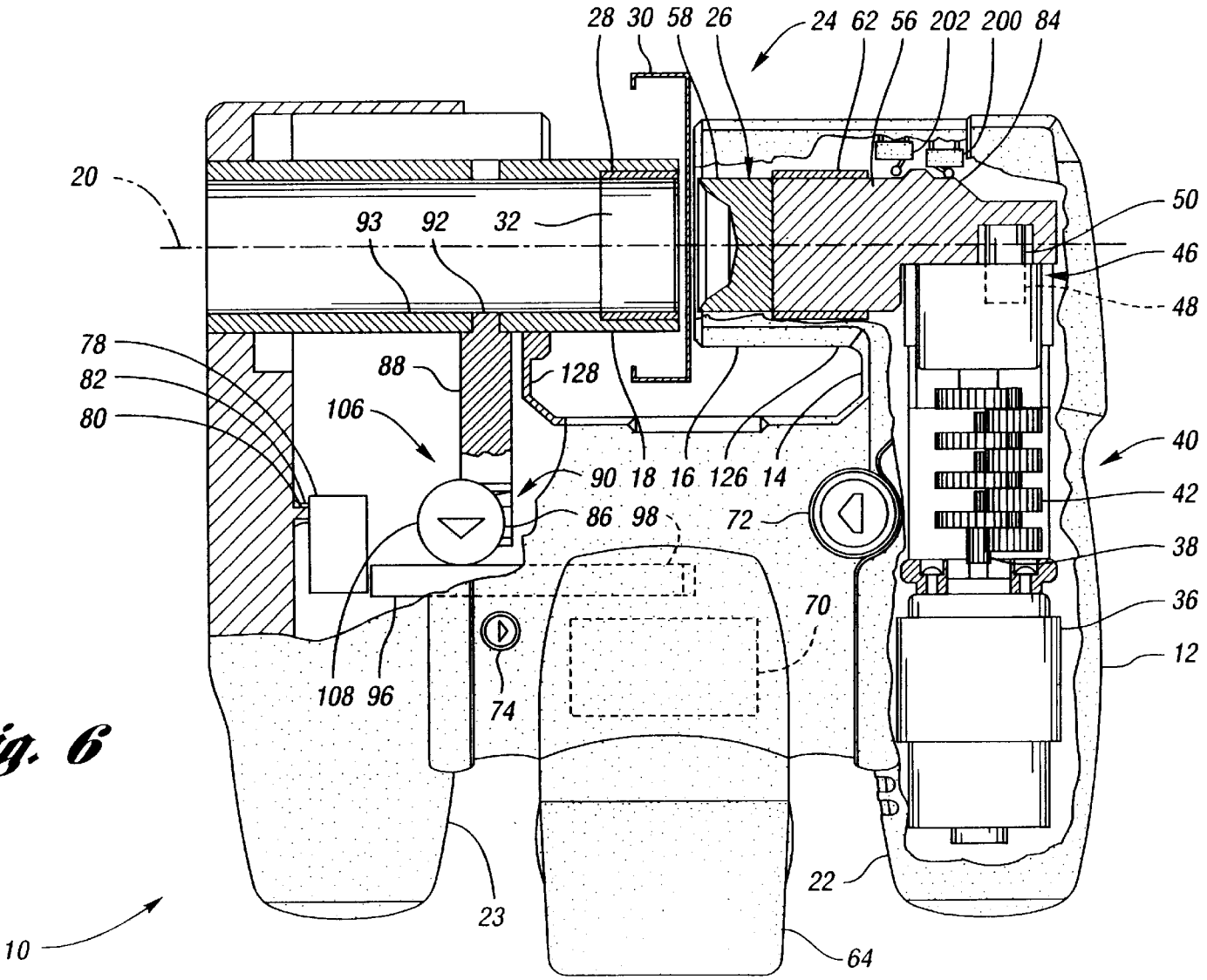
FIG. 6 is a preferred apparatus of the present invention for punching steel studs, showing first and second assertable limit switches at the punch holder, with the punch and the die in the closed position, and deactuated.
Figure 7:
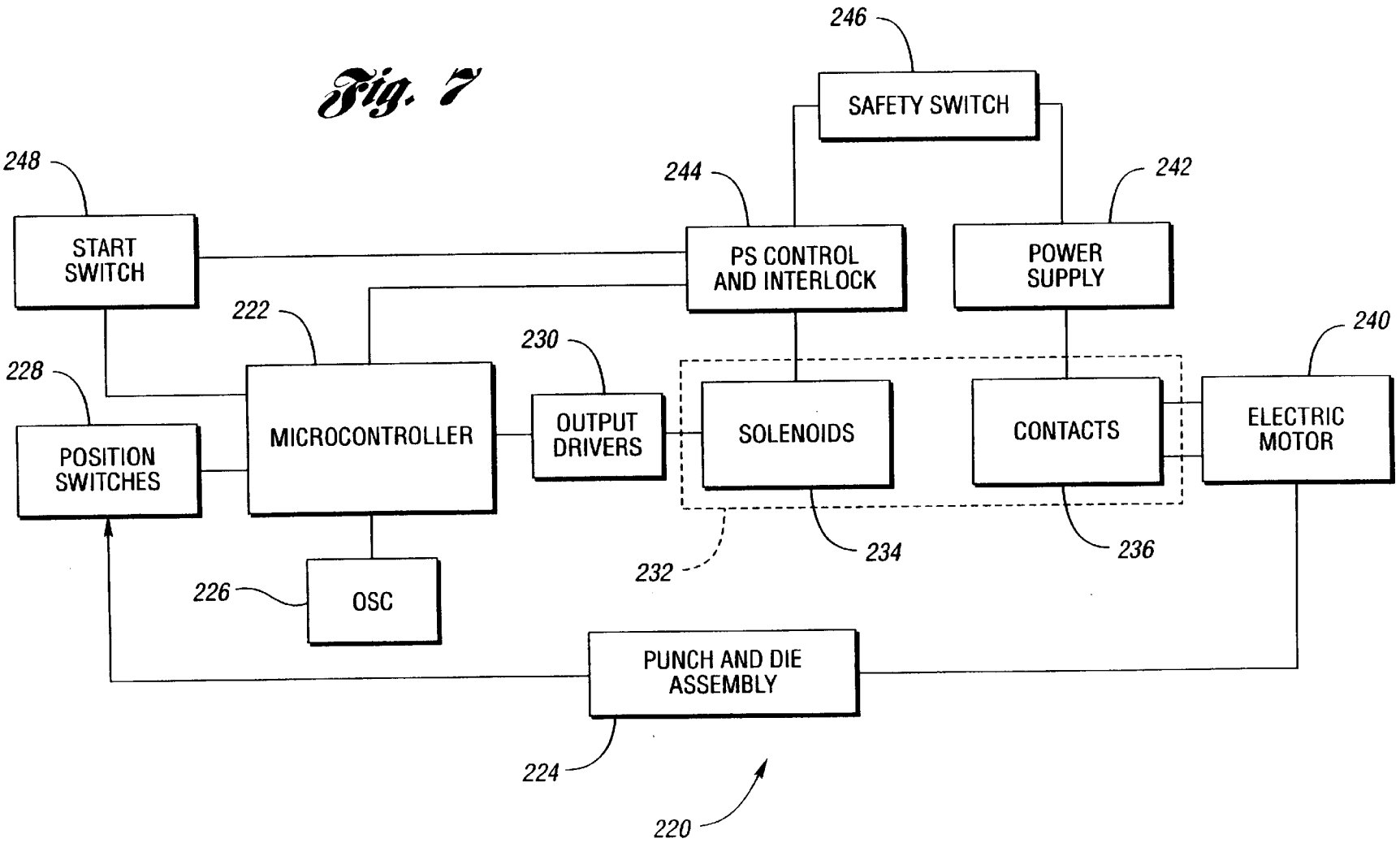
FIG. 7 is a logical block diagram for the control circuit in a preferred embodiment of the present invention.
Figure 8:
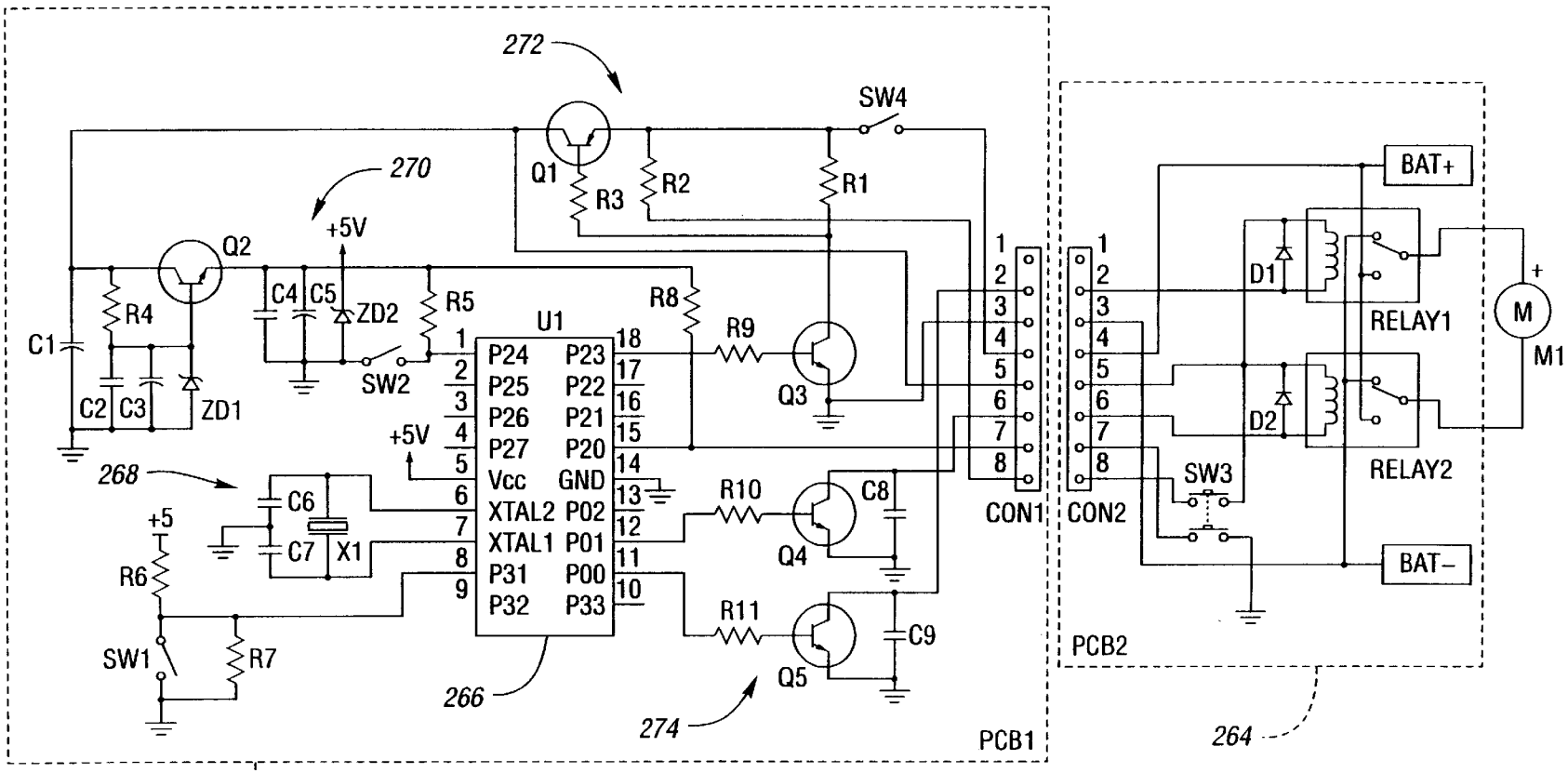
FIG. 8 is an example of a suitable circuit for implementing the control circuit illustrated in FIG. 7.

With reference now to FIGS. 6–8, the most preferred embodiment of the present invention is illustrated. In FIG. 6, the apparatus is substantially similar to that shown in FIGS. 1–3, and as such, like reference numerals have been used to indicate like parts. Specifically, in FIG. 6, the apparatus includes a first assertable limit switch 200 and a second assertable limit switch 202. The use of multiple position switches, at this time, is the most preferred embodiment of the present invention. Specifically, first limit switch 200 is asserted when the punch and die assembly is in the deactuated position. Second limit switch 202 is asserted when the punch and die assembly has moved sufficiently from the deactuated position toward the actuated position such that the punched hole has been formed. That is, the deassertion of the first limit switch indicates that the punch has begun moving toward the actuated position. As shown in FIG. 6, first limit switch 200 is in the asserted state. On the other hand, second limit switch 202 becomes asserted. When the punch and die assembly has moved sufficiently from the deactuated position to the actuated position such that the punched hole has been formed. As shown in FIG. 6, second limit switch 202 is deasserted.

FIG. 7 illustrates the operation of a control circuit in accordance with the embodiment of the present invention shown in FIG. 6. In FIG. 7, the control circuit is shown at the logical level, and it is appreciated that the present invention is not limited to any particular circuit level implementation, although a working example of a circuit implementation is shown in FIG. 8. In FIG. 7, a logical level diagram of the control circuit is generally indicated at 220.

Control circuit 220 is logically configured in accordance with the present invention to selectively drive a suitable driving mechanism for the hand-held punch, such as an electric motor. In the alternative, control circuit 220 may be used to actuate a valve to selectively supply fluid power to a turbine driven embodiment. Accordingly, control circuit 220 is not limited to any particular type of driving mechanism, but it is shown configured to selectively connect power to an electric motor for illustration. Control circuit 220 includes a microcontroller 222. Of course, although the use of a programmable microcontroller is preferred, it is appreciated that a discrete circuit arrangement or a programmable microprocessor may be used in the alternative. Preferably, microcontroller 222 is an 8-bit microcontroller such as the Z86E0208PSC available from Zilog, Inc., Campbell, Calif.

Microcontroller 222 is connected to output drivers 230. Output drivers 230 drive solenoids 234 to close contacts 236 of relay arrangement 232. The closing of contacts 236 selectively operates a driving mechanism such as electric motor 240. Electric motor 240 operates punch and die assembly 224. In this embodiment, at least one and preferably first and second position switches 228 sense the position of the punch and die assembly. The output of the limit switch is provided to microcontroller 222. Preferably, microcontroller 222 is capable of timing events, such as the assertion of the limit switches. As shown, external oscillator 226 is used by microcontroller 222 for timing. In addition to position switches 228, a start or main switch 248 is connected to microcontroller 222. In this embodiment of the present invention, a power supply control interlock circuit 244 allows selective operation of the driving mechanism in response to momentary assertion of start switch 248. As shown, power supply control interlock circuit 244 is connected to microcontroller 222, start switch 248, and solenoids 234. Further, power supply control 244 is connected to power supply 242, preferably through a safety switch 246.

In operation, microcontroller 222 drives output drivers 230, which in turn, supply current to solenoids 234 to close contacts 236, and drive electric motor 240. The electric motor 240 drives punch and die assembly 224, with the punch and die assembly actuating various position switches 228 at various positions in the working cycle.

Controller 222 receives inputs from position switches 228. External clock 226 is provided to microcontroller 222, and microcontroller 222 includes internal timers for timing events such as elapsed time between assertion and deassertion of various limit switches or the start switch. Power supply control and interlock circuit 244 allows a momentary assertion of start switch 248 to cause the punch and die assembly to be driven over the entire working cycle.

Preferably, power supply control interlock circuit 244 maintains a power connection to the control circuit such as microcontroller 222 after the control circuit halts the driving mechanism. When the timer exceeds the powerdown threshold, microcontroller 222 is configured to reset the interlock circuit which disconnects the power connection to the control circuit. Additionally, preferably, the control circuit is configured to halt the driving mechanism when the timer exceeds an initial movement threshold before the first limit switch is deasserted after the momentary assertion of the main switch. This stops the output driver when the punch and die assembly is stuck in the deactuated position, possibly due to a low battery.

Further, preferably, the control circuit is configured to halt the driving mechanism when the timer exceeds a punch timeout threshold before the second limit switch is asserted. The timer is reset by the momentary assertion of the main switch. This feature detects when the stud has not been punched after sufficient time has been allowed for punching to take place. This detection may occur when the punch is overloaded.

In some embodiments, the detection above, that is, the timer exceeding a punch timeout threshold before the second limit switch is asserted, results in the reversing of the motor by the control circuit. In the alternative, the control circuit may simply stop driving the driving mechanism after the punch timeout threshold is exceeded before the second limit switch is asserted.

In addition to the timer events discussed above, preferred embodiments of the present invention have the control circuit configured to halt the driving mechanism when the timer exceeds a forward return timeout threshold before the first limit switch is asserted after the punch and die assembly begins the working cycle. Further, when the driving mechanism is reversed, possibly due to an overload, the control circuit preferably halts the driving mechanism when the timer exceeds a reverse return timeout threshold.

With reference now to FIG. 8, a working example of a control circuit at the component level is generally indicated at 260. It is appreciated that control circuit 260 of FIG. 8 is one implementation for the control circuit 220 of FIG. 7, and many implementations are possible in accordance with the present invention. Control circuit 260 includes first printed circuit board 262 and the second printed circuit board 264. A microcontroller 266, such as the Z86E0208PSC, receives various inputs and has outputs to the output drivers and to the interlock circuit. An oscillator circuit 268 includes capacitor C6 and C7 and crystal oscillator X1, which is an 8 megahertz oscillator. Power supply circuit 270 includes capacitors C1, C2, C3, and resistor R4, in addition to zenor diode ZD1 and transistor Q2. Further, power supply circuit 270 includes capacitors C4 and C5 and zenor diode ZD2. The first limit switch (200, FIG. 6) is shown as switch SW1 and cooperates with resistors R6 and R7 to provide an input to microcontroller 266. Second limit switch (202, FIG. 6) is implemented as switch SW2 and cooperates with resistor R5 to provide an input to microcontroller 266. As shown, asserting switch SW1 pulls input P31 low, while the assertion of switch SW2 pulls input P24 low. Microcontroller 266 processes the input bits in conjunction with internal timing information to control output P23 to the interlock circuit and outputs P01 and P00 to the output driver transistors.

With continuing reference to FIG. 8, the interlock circuit is generally indicated at 272 and includes transistor Q1 and resistors R1, R2 and R3. In addition, interlock circuit 272 includes transistor Q3 and input resistor R9. Switch SW4 is a safety switch and connects interlock circuit 272 to the battery, on the second printed circuit board 264. The two printed circuit boards are connected by a ribbon cable between connector CON1 and connector CON2. As shown, the second printed circuit board 264 includes the start switch implemented as switch SW3. Switch SW3 includes two physical switches. Asserting SW3 pulls input P20 low and resistor R8 limits current. Pulling P20 low indicates to microcontroller 266 that the start button has been depressed. Further, asserting SW3 connects the emitter and the collector of transistor Q1 across resistor R2 to turn on transistor Q1 of the interlock circuit. Microcontroller 266, in turn, turns on transistor Q3 to keep transistor Q1 turned on after switch SW3 is released. That is, transistors Q1 and Q3 form the interlock. The output drivers of the circuit, on the first printed circuit board 262, include transistors Q4 and Q5. Input resistors R10 and R11 limit base current of transistors Q4 and Q5, respectively. Capacitors C8 and C9 add capacitance at the respective collectors. Transistor Q4 drives relay 2, and diode D2 limits voltage at the collector of transistor Q4. Transistor Q5 drives relay 1, and diode D1 limits voltage at the collector of transistor Q5. The relays are controlled to connect motor M1 between battery terminals BAT+ and BAT−.

In accordance with a preferred implementation of the present invention, control circuit 260 includes interlock circuit 272. In preferred implementations, microcontroller 266 monitors switches SW1 and SW2 and uses an internal timer to provide more enhanced control over the output drivers at pins P01 and P00 and, preferably, may turn off transistor Q3 when the apparatus has not been used for a significant amount of time, such as one hour. It is appreciated that a programmable microcontroller allow various enhancements to be made to the control of the apparatus, the specific examples included herein are preferred by the inventors at this time, but are not intended to illustrate all possible control enhancements in accordance with the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A portable hand-held apparatus for punching light gauge steel framing studs used in building construction to form holes of sufficient size to allow building wiring and piping to extend therethrough, the apparatus comprising:

a frame;

a punch and die assembly supported by the frame and including a punch and a die mounted opposite each other for movement relative to each other, the die having a body defining a cavity for receiving the punch;

a driving mechanism mounted to the frame and selectively operable to drive the punch and die assembly over a working cycle including a deactuated position in which the punch and the die are spaced apart with the stud positioned therebetween, and an actuated position in which the punch extends into the die cavity by punching through the stud to form a punched hole;

an assertable limit switch that is asserted when the punch and die assembly is in the deactuated position;

an assertable main switch that is assertable by a user; and a control circuit connected to the limit switch and the main switch and having an output connected to the driving mechanism, wherein the control circuit is configured to selectively operate the driving mechanism in response to assertion of the main switch by the user to drive the punch and die assembly from the deactuated position, over the working cycle, through the actuated position to form the punched hole, and continuing to drive the punch and die assembly to the deactuated position to complete the cycle and assert the limit switch, and wherein the control circuit is configured to halt operation of the driving mechanism in response to assertion of the limit switch.

2. The apparatus of claim 1 wherein the control circuit further comprises:

a timer configured to halt operation of the driving mechanism after a predetermined time elapses from the assertion of the main switch without the punch and die assembly completing the cycle.

3. The apparatus of claim 2 wherein the driving mechanism is battery powered.

4. The apparatus of claim 1 wherein the driving mechanism is an electric motor.

5. The apparatus of claim 4 wherein the motor has a predetermined threshold current and the apparatus further comprises:

a current sensor connected to the motor for sensing a motor current, the sensor being configured to provide an overload signal to the control circuit in response to the motor current exceeding the threshold current.

6. The apparatus of claim 5 wherein the control circuit is configured to halt operation of the electric motor upon receiving the overload signal.

7. The apparatus of claim 5 wherein the motor is operable in a first direction and a second direction, and wherein the control circuit is configured to reverse the direction of the electric motor upon receiving the overload signal.

8. The apparatus of claim 5 further comprising:

an overload action selection switch having a first state and a second state, wherein the control circuit is configured to halt operation of the electric motor upon receiving the overload signal when the selection switch is in the first state, and wherein the control circuit is configured to reverse the direction of the electric motor upon receiving the overload signal when the selection switch is in the second state.

9. The apparatus of claim 4 wherein the motor is operable in a first direction and a second direction, and the apparatus further comprises:

an assertable reverse switch connected to the control circuit, wherein the control circuit is configured to operate the motor in the first direction when the reverse switch is deasserted and to operate the motor in the second direction when the reverse switch is asserted.

10. The apparatus of claim 9 wherein the control circuit operates the motor in the second direction upon the assertion of the reverse switch followed by the assertion of the main switch.

11. The apparatus of claim 4 wherein the motor has a predetermined punching threshold current and the apparatus further comprises:

a current sensor connected to the motor, the sensor being configured to provide a punching signal in response to the motor current exceeding the punching threshold current indicating that the punched hole has been formed.

12. The apparatus of claim 11 further comprising:

a counter holding a value representing a number of punched holes made with the apparatus and receiving the punching signal, the counter incrementing the value upon receiving the punching signal; and a display that displays the value in the counter to the user.

13. The apparatus of claim 1 wherein the driving mechanism is a turbine driven by the fluid source.

14. The apparatus of claim 1 wherein the frame includes a generally C-shaped portion including first and second halves, each half including an end and the ends being spaced apart for holding the punch and the die and for receiving the stud between the punch and the die, the apparatus further comprising:

a slide member connecting the first and second halves of the C-shaped frame portion and allowing sliding movement of the die toward and away from the punch by moving the slide member; and an assertable safety switch that is asserted when the first and second frame portion halves are positioned adjacent each other, and that is deasserted when the first and second frame portion halves are positioned apart from each other, wherein the control circuit is configured to selectively operate the driving mechanism while the safety switch is asserted and to block all operation of the driving mechanism while the safety switch is deasserted.

15. A portable hand-held apparatus for punching light gauge steel framing studs used in building construction to form holes of sufficient size to allow building wiring and piping to extend therethrough, the apparatus comprising:

a frame;

a punch and die assembly supported by the frame and including a punch and a die mounted opposite each other for movement relative to each other, the die having a body defining a cavity for receiving the punch;

an electric motor mounted to the frame and selectively operable to drive the punch and die assembly over a working cycle including a deactuated position in which the punch and the die are spaced apart with the stud positioned therebetween, and an actuated position in which the punch extends into the die cavity by punching through the stud to form a punched hole, the motor having a predetermined punching threshold current;

a current sensor connected to the motor, the sensor being configured to provide a punching signal in response to motor current exceeding the punching threshold current indicating that the punched hole has been formed;

a counter holding a value representing a number of punched holes made with the apparatus and receiving the punching signal, the counter incrementing the value upon receiving the punching signal; and a display that displays the value in the counter to a user.

16. A portable hand-held apparatus for punching knock-outs out of light gauge steel framing studs used in building construction to form holes of sufficient size to allow building wiring and piping to extend therethrough, the apparatus comprising:

a compact hand held frame having a generally C-shaped portion with spaced apart ends for receiving a stud therebetween, and a handle for gripping by a user;

a punch and die assembly including a punch and a die mounted opposite each other at the ends of the C-shaped frame portion, the punch and the die being mounted for movement relative to each other, the die having a body defining a cavity, and the punch being configured with respect to the cavity such that punching a hole produces a knock-out;

an actuatable driving mechanism mounted to the frame and operable to drive the punch and die assembly over a working cycle including a deactuated position in which the punch and the die are spaced apart with the stud positioned therebetween, and an actuated position in which the punch extends into the die cavity by punching through the stud to form a punched hole;

an assertable limit switch that is asserted when the punch and die assembly is in the deactuated position;

an assertable main switch that is assertable by a user; and a control circuit connected to the limit switch and the main switch and having an output connected to the driving mechanism, wherein the control circuit is configured to selectively operate the driving mechanism in response to assertion of the main switch by the user to drive the punch and die assembly from the deactuated position, over the working cycle, through the actuated position to form the punched hole, and continuing to drive the punch and die assembly to the deactuated position to complete the cycle and assert the limit switch, and wherein the control circuit is configured to halt operation of the driving mechanism in response to assertion of the limit switch.

17. A portable hand-held apparatus for punching knock-outs out of light gauge steel framing studs used in building construction to form holes of sufficient size to allow building wiring and piping to extend therethrough, the apparatus comprising:

a compact hand held frame having a generally C-shaped portion with spaced apart ends for receiving a stud therebetween, and a handle for gripping by a user;

a punch and die assembly including a punch and a die mounted opposite each other at the ends of the C-shaped frame portion, the punch and the die being mounted for movement relative to each other, the die having a body defining a cavity, and the punch being configured with respect to the cavity such that punching a hole produces a knock-out;

an electric motor mounted to the frame and operable to drive the punch and die assembly over a working cycle including a deactuated position in which the punch and the die are spaced apart with the stud positioned therebetween, and an actuated position in which the punch extends into the die cavity by punching through the stud to form a punched hole, the motor having a predetermined punching threshold current;

a current sensor connected to the motor, the sensor being configured to provide a punching signal in response to motor current exceeding the punching threshold current indicating that the punched hole has been formed;

a counter holding a value representing a number of punched holes made with the apparatus and receiving the punching signal, the counter incrementing the value upon receiving the punching signal; and a display that displays the value in the counter to the user.

18. A portable hand-held apparatus for punching light gauge steel framing studs used in building construction to form holes of sufficient size to allow building wiring and piping to extend therethrough, the apparatus comprising:

a frame;

a punch and die assembly supported by the frame and including a punch and a die mounted opposite each other for movement relative to each other, the die having a body defining a cavity for receiving the punch;

a driving mechanism mounted to the frame and selectively operable to drive the punch and die assembly over a working cycle including a deactuated position in which the punch and the die are spaced apart with the stud positioned therebetween, and an actuated position in which the punch extends into the die cavity by punching through the stud to form a punched hole;

an assertable first limit switch that is asserted when the punch and die assembly is in the deactuated position;

an assertable main switch that is assertable by a user; and a control circuit connected to the first limit switch and the main switch and having an output connected to the driving mechanism, wherein the control circuit is configured with an interlock circuit to allow selective operation of the driving mechanism in response to a momentary assertion of the main switch by the user to drive the punch and die assembly from the deactuated position, over the working cycle, through the actuated position to form the punched hole, and wherein the control circuit is configured to halt operation of the driving mechanism when the first limit switch is asserted after driving the punch and die assembly over the working cycle to the deactuated position.

19. The apparatus of claim 18 wherein the interlock circuit is configured to maintain a power connection to the control circuit after the control circuit halts the driving mechanism.

20. The apparatus of claim 19 wherein the control circuit includes a timer.

21. The apparatus of claim 20 wherein the control circuit is configured to reset the interlock circuit and disconnect the power connection to the control circuit when the timer exceeds a powerdown threshold, the timer being reset by the momentary assertion of the main switch.

22. The apparatus of claim 20 wherein the control circuit is configured to halt the driving mechanism when the timer exceeds an initial movement threshold before the first limit switch is deasserted, the timer being reset by the momentary assertion of the main switch.

23. The apparatus of claim 20 further comprising:

an assertable second limit switch that is asserted when the punch and die assembly has moved sufficiently from the deactuated position toward the actuated position such that the punched hole has been formed, wherein the control circuit is configured to halt the driving mechanism when the timer exceeds a punch timeout threshold before the second limit switch is asserted, the timer being reset by the momentary assertion of the main switch.

24. The apparatus of claim 20 further comprising:

an assertable second limit switch that is asserted when the punch and die assembly has moved sufficiently from the deactuated position toward the actuated position such that the punched hole has been formed, wherein the control circuit is configured to reverse the driving mechanism when the timer exceeds a punch timeout threshold before the second limit switch is asserted, the timer being reset by the momentary assertion of the main switch.

25. The apparatus of claim 24 wherein the control circuit is configured to halt the driving mechanism when the timer exceeds a reverse return timeout threshold before the first limit switch is asserted after the reversing of the driving mechanism.

26. The apparatus of claim 20 wherein the control circuit is configured to halt the driving mechanism when the timer exceeds a forward return timeout threshold before the first limit switch is asserted after the punch and die assembly begins the working cycle.

27. The apparatus of claim 18 further comprising:

an assertable safety switch, wherein the control circuit is configured to prevent operation of the driving mechanism while the safety switch is deasserted.

28. A portable hand-held apparatus for punching knock-outs out of light gauge steel framing studs used in building construction to form holes of sufficient size to allow building wiring and piping to extend therethrough, the apparatus comprising:

a compact hand held frame having a generally C-shaped portion with spaced apart ends for receiving a stud therebetween, and a handle for gripping by a user;

a punch and die assembly including a punch and a die mounted opposite each other at the ends of the C-shaped frame portion, the punch and the die being mounted for movement relative to each other, the die having a body defining a cavity, and the punch being configured with respect to the cavity such that punching a hole produces a knock-out;

an actuatable driving mechanism mounted to the frame and operable to drive the punch and die assembly over a working cycle including a deactuated position in which the punch and the die are spaced apart with the stud positioned therebetween, and an actuated position in which the punch extends into the die cavity by punching through the stud to form a punched hole;

an assertable limit switch that is asserted when the punch and die assembly is in the deactuated position;

an assertable main switch that is assertable by a user; and a control circuit connected to the limit switch and the main switch and having an output connected to the driving mechanism, wherein the control circuit is configured with an interlock circuit to allow selective operation of the driving mechanism in response to a momentary assertion of the main switch by the user to drive the punch and die assembly from the deactuated position, over the working cycle, through the actuated position to form the punched hole, and wherein the control circuit is configured to halt operation of the driving mechanism when the limit switch is asserted after driving the punch and die assembly over the working cycle to the deactuated position.

* * * * *